United States Patent [19]

Witte

[11] 4,069,790

[45] Jan. 24, 1978

[54] EQUIPMENT FOR SURFACE TREATMENT

[76] Inventor: Stefan Oh Witte, Lindasvagen 106, S-430 181 Billdal, Sweden

[21] Appl. No.: 738,005

[22] Filed: Nov. 2, 1976

[30] Foreign Application Priority Data

Nov. 12, 1975 Sweden ..... 7512675

[51] Int. Cl.[2] ..... B05C 13/02

[52] U.S. Cl. ..... 118/70; 118/500; 134/19; 198/494; 198/952

[58] Field of Search ..... 118/70, 500; 134/19.2; 198/494, 952

[56] References Cited

U.S. PATENT DOCUMENTS

| | | | |
|---|---|---|---|
| 2,729,191 | 1/1956 | Ransburg | 118/500 X |
| 2,730,988 | 1/1956 | Starkey | 118/500 X |
| 2,839,651 | 6/1958 | Erickson | 198/952 |
| 3,762,951 | 10/1973 | Hetznecker | 118/500 X |
| 3,830,196 | 8/1970 | Guttman et al. | 118/70 |
| 3,909,289 | 9/1975 | Foucart et al. | 118/70 X |

FOREIGN PATENT DOCUMENTS

| | | | |
|---|---|---|---|
| 207,857 | 5/1957 | Australia | 134/19 |

*Primary Examiner*—James Kee Chi

[57] ABSTRACT

Equipment for surface treatment of articles, providing means for uniformly cleaning and completely burning off undesirable coatings formed on elements supporting the articles subjected to treatment. The equipment includes metallic elements for supporting the articles subjected to treatment, heating filaments placed inside each of the metallic elements, and a conveyor for moving the supporting elements through treatment and cleaning stations.

The heating filaments, each of which is separated from each of the metallic supporting elements by an insulating layer, form parts of electrical circuits for heating the supporting elements, and burning off therefrom any coating material that adhered thereto at the treatment station.

5 Claims, 5 Drawing Figures

EQUIPMENT FOR SURFACE TREATMENT

Figure 1:
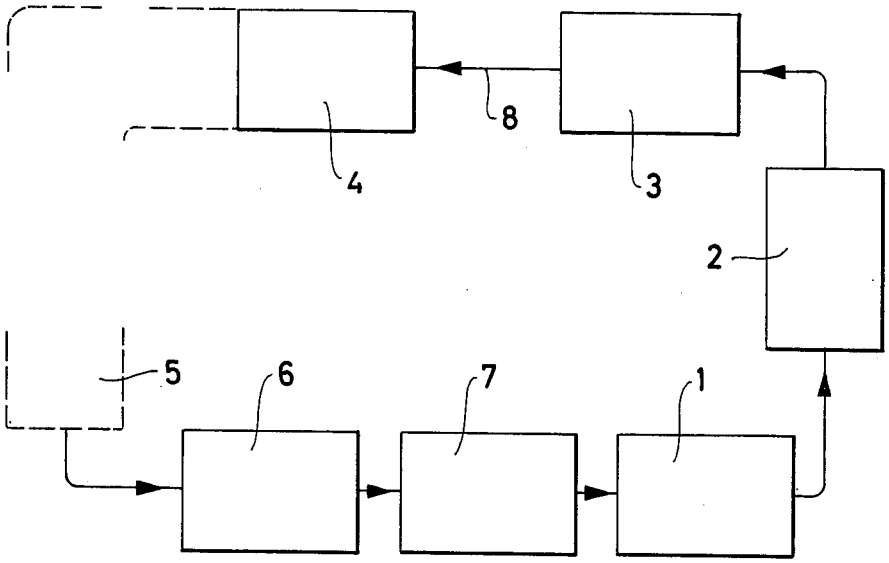

The present invention relates to an equipment for surface treatment comprising metallic supporting elements for objects, which are going to be treated.

Surface treatment in series, especially enameling is often carried out in such a manner that the related objects, suspended in supporting elements, often exhibiting a hook shape and hanging down from a conveyor, are transported through a spray booth, in which the surface treatment takes place. However, after some time of use the supporting elements get coated with a thick layer of the material used for the surface treatment. This creates problems, especially in connection with electrostatic surface treatment, as for example electrostatic enameling, when the work piece is grounded via the supporting elements, in which it is suspended. As a matter of fact after a few passages through the spray booth the supporting elements get such a heavy deposit of paint that the conduction between the work piece and the supporting element practically ceases to exist bringing about very poor treatment results. As examples of the drawbacks arising in connection with deficient grounding of the object intended for treatment bad turn-in, uneven distribution of the paint, formation of craters and so called pin holes, a high consumption of paint and spark formation can be mentioned. This leads to a high percentage of re-painting operations and rejects, which results in bad economy.

In order to avoid these drawbacks, one has earlier proposed to burn the paint adhering to the supporting elemets, by way of example in an oil barrel, which involves the removal of the supporting elements from the conveyor for a certain period of time with resulting serious interruptions in the manufacturing program. Another method involves the chemical cleaning of the hooks, which also brings in its train comparatively inconvenient interruptions. A third method simply involves the throwing away of the supporting elements after some time of use, which is very uneconomical. One more proposition involves letting the supporting elements pass through a burning-off furnace, in which they are heated by means of an external heating source. A known furnace of this kind exhibits infrared heating tubes arranged along the path of the supporting elements through the furnace, which tubes focus the IR-radiation, the supporting elements being brought to pass through said focus, in which the heat effect per surface unit is very high, whereby a carbonization of coking type takes place. After the heat zone there is as a rule a flushing zone, where water and compressed air in the form of a mist is sprayed onto the supporting elements. When the water gets in contact with the hot supporting elements, it evaporates blasting away the coking residues from the supporting elements. However, such an installation exhibits the drawback that it is very energy consuming. In addition the length of the furnace and consequently also the cost of its manufacture is dependant on the speed and size of the supporting elements. Moreover, the furnace is comparatively limited with respect to the height of the supporting elements to be burned. Another drawback is the fact that only a very limited portion of the supporting elements will be burned clean. An especially poor result will be obtained, if the supporting elements are very branched and exhibit a relatively great vertical extension.

In addition the burning installations in question for cleaning purpose result very expensive.

It is a principal object of the invention to provide an equipment of the kind mentioned, in which the drawbacks described are eliminated, i.e. an equipment, where the risk of serious interruptions of the function is greatly reduced, the manufacturing cost of which is comparatively low, and by means of which a uniform and complete burning-off of the entire portion of the supporting elements exposed to getting coated is obtained irrespective of the shape of the supporting element and its extension in different directions, and irrespective of variations with respect to its size and the extension of the individual supporting element in its arrangement along one and the same conveyor.

Said object is reached by means of an equipment made in accordance with the invention, which substantially is characterized by the supporting elements in themselves constituting heating bodies of the resistance type, which can be connected to an electric circuit, or by said supporting elements being provided with such heating bodies.

Figure 2:
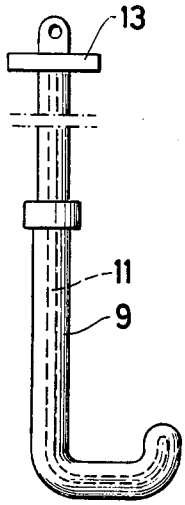
Figure 4:
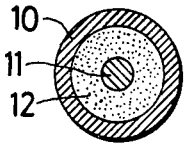
Figure 3:
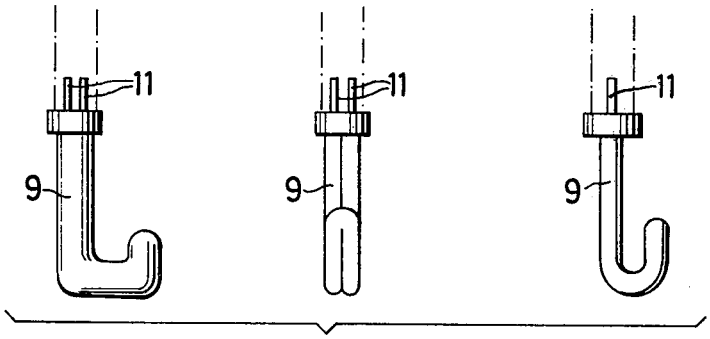
Figure 5:
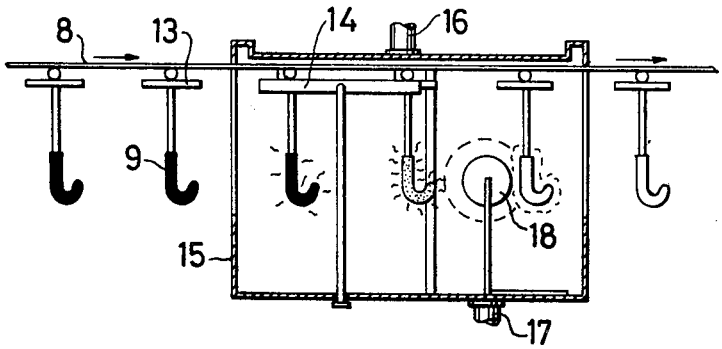

In the following an example of an embodiment of the invention is described, reference being made to the accompanying drawings, in which FIG. 1 is a schematical plan view of the track of an installation for treatment, of which the equipment according to the invention forms part, FIG. 2 is a view of a detail forming part of the equipment, FIG. 3 is a view corresponding to the FIG. 2 showing two different alternative designs of the same detail, FIG. 4 shows a cross section of a portion of the detail illustrated in FIG. 3, and FIG. 5 is a side elevational view of the section of the track of an installation for treatment, within which the cleaning of supporting elements forming part of the equipment takes place.

In the track of an installation for treatment illustrated in FIG. 1, for surface treatment intended objects are hanged up on supporting elements hanging down from a conveyor at the station indication with 1. Pretreatment of objects to be enameled takes place at station 2, whereafter the spraying operation is performed at station 3. The enameled objects are thereafter dried in a drying oven 4, whereafter they pass to a cooling-off zone 5. Thereafter said objects are removed at station 6. Before hanging up new objects the supporting elements are cleaned at station 7. The pretreatment made at station 2 can include a degreasing operation, if so is deemed necessary before enameling.

As is most clearly evident from FIG. 5, a number of supporting elements 9 are supported in a conveyor 8, from which they hang down. Said supporting elements certainly need not be so simple as the ones illustrated in the drawings, but can of course exhibit a very complicated shape with branches in different directions without therefore departing from the fundamental idea of the invention. Each one of the supporting means comprises a tube 10 bent to desired shape, which tube suitably can be made of stainless steel. In its interior hollow space the tube exhibits a heating filament 11, which is kept insulated from the conducting casing 10 by means of an in between insulating layer 12, which suitably can consist of magnesium oxide, which is a good electric insulator at the same time as it exhibits good heat conducting properties. In the embodiment illustrated in FIG. 4 the tube 10 only holds a resistance wire 11, the tube in itself constituting an electric return conductor thus being connected in series with the inner resistance wire 11. In connection with tubes of large dimensions the lead-in as well as the return conductor can be arranged inside the tube, as is shown in the left embodiment of FIG. 3. However, when the supporting elements are of thin structure, it is suitable to let the tube itself serve the purpose of return conductor. Each one of the supporting means at its upper portion exhibits a current collector 13, which suitably can be designed in the shape of a rail, and which is arranged in such a manner that it cooperates with a corresponding fixed contact rail 14, which extends along a portion of the path of movement of the supporting elements and is connected with a power source. An oven unit, in which the contact rail 14 is provided, is indicated with 15. The oven unit is ventilated at its to by means of an exhaust duct 16, and sludge is separated in its lower portion by means of a duct 17. A flushing device is indicated with 18.

When the current collector 13 of the supporting means establishes contact with the contact rail 14, the circuit is closed via the resistance wire extending through the supporting element, which wire is strongly heated and thereby also causes the tubular casing 10 of the supporting element to be strongly heated. This heating continues, as long as the current collector 13 is in contact with the current rail 14. When the supporting elements pass the flushing device 18, the remaining coke residues are blasted away from the supporting element in connection with the generation of steam that takes place, when the flush water strikes the strongly heated surface.

The invention is not limited to the embodiment described above and illustrated in the drawings by way of example only, but can be varied as to its details within the scope of the following claims without therefore departing from the fundamental idea of the invention.

I claim:

1. Equipment for surface treatment of the type comprising, metallic supporting elements for objects subjected to treatment and a conveyor for moving the supporting elements through treatment and cleaning stations, in combination with a heating filament disosed inside each of the metalic supporting elements, and an insulating layer separating said heating filament from each of the metallic supporting elements, said heating filament forming part of an electrical circuit for heating of the supporting elements and burning off any coating material that adhered thereto at the treatment station.

2. Equipment according to claim 1, wherein each of the supporting elements comprises a casing having a tubular shape and a hollow interior, and said heating filament being disposed in said hollow interior.

3. Equipment according to claim 2, wherein said insulating layer consists of magnesium oxide and is disposed between said heating filament and said casing filling the space surrounding said heating filament.

4. Equipment according to claim 2, wherein said heating filament constitutes a single wire line connected in series with said casing, the latter constituting an electric return conductor and forming a portion of an electrical circuit so that each of the supporting elements in itself constitutes a heating body.

5. Equipment according to claim 1, wherein each of the supporting elements further comprises, a rail-shaped current collector, disposed at the upper portion thereof, and means for cooperating with said current collector, said cooperating means being connected to a power source and forming thereby a closed circuit with the supporting elements, in order to heat up the same for the burning off of any coating material adhered thereto at the treatment station.

* * * * *